US010174586B2

(12) United States Patent
Symms

(10) Patent No.: US 10,174,586 B2
(45) **Date of Patent: *Jan. 8, 2019**

(54) ELECTRONICALLY-ACTUATED CEMENTING PORT COLLAR

(71) Applicant: Weatherford Technology Holdings, LLC, Houston, TX (US)

(72) Inventor: Joshua V. Symms, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 119 days.

This patent is subject to a terminal disclaimer.

(21) Appl. No.: 15/130,757

(22) Filed: Apr. 15, 2016

(65) Prior Publication Data

US 2016/0258249 A1 Sep. 8, 2016

Related U.S. Application Data

(63) Continuation of application No. 13/952,202, filed on Jul. 26, 2013, now Pat. No. 9,316,091.

(51) Int. Cl.

| | |
|---|---|
| ***E21B 34/14*** | (2006.01) |
| ***E21B 34/06*** | (2006.01) |
| ***E21B 33/14*** | (2006.01) |
| *E21B 34/00* | (2006.01) |
| *E21B 33/12* | (2006.01) |

(52) U.S. Cl.

CPC ..... *E21B 34/066* (2013.01); *E21B 33/146* (2013.01); *E21B 34/14* (2013.01); *E21B 33/12* (2013.01); *E21B 2034/007* (2013.01)

(58) Field of Classification Search

CPC ..... E21B 34/066

See application file for complete search history.

(56) References Cited

U.S. PATENT DOCUMENTS

| | | | | |
|---|---|---|---|---|
| 4,736,791 | A * | 4/1988 | Rorden | E21B 34/06 166/319 |
| 5,024,273 | A * | 6/1991 | Coone | E21B 33/127 166/154 |
| 5,299,640 | A * | 4/1994 | Streich | E21B 33/16 166/327 |

(Continued)

OTHER PUBLICATIONS

First Examination Report in counterpart EP Appl. 14178853.3, dated Mar. 16, 2018, 5-pgs.

*Primary Examiner* — Janine M Kreck

(74) *Attorney, Agent, or Firm* — Blank Rome LLP

(57) ABSTRACT

A cementing port collar has an opening sleeve biased from a closed position to an opened position relative to the collar's exit port, and a first restraint temporarily holds the opening sleeve closed. The collar also has a closing sleeve biased from an opened position to a closed position, and a second restraint temporarily holds the closing sleeve opened. During cementing, the first restraint is electronically activated with a first trigger to release the opening sleeve opened so cement slurry can pass out of the collar's exit port to the borehole annulus. When cementing is completed, the second restraint is electronically activated with a second trigger to release the closing sleeve closed to close off the collar to the borehole so the cement can set. The restraints can include bands of synthetic fiber, which are burned by fuses activated by a controller of the collar responding to passage of RFID tags.

20 Claims, 16 Drawing Sheets

(56) References Cited

U.S. PATENT DOCUMENTS

| | | | | |
|---|---|---|---|---|
| 9,316,091 | B2 * | 4/2016 | Symms | E21B 34/066 |
| 9,587,486 | B2 * | 3/2017 | Walton | E21B 47/122 |
| 2014/0305662 | A1 * | 10/2014 | Giroux | E21B 33/14 166/386 |

* cited by examiner

ELECTRONICALLY-ACTUATED CEMENTING PORT COLLAR

BACKGROUND OF THE DISCLOSURE

Cementing operations are used in wellbores to fill the annular space between casing and the formation with cement. Once set, the cement helps isolate production zones at different depths within the wellbore. Currently, cementing operations can flow cement into the annulus from the bottom of the casing (e.g., cementing the long way) or from the top of the casing (e.g., reverse cementing).

Due to weak earth formations or long strings of casing, cementing from the top or bottom of the casing may be undesirable or ineffective. For example, when circulating cement into the annulus from the bottom of the casing, problems may be encountered because a weak earth formation will not support the cement as it rises on the outside of the annulus. As a result, the cement may flow into the formation rather than up the casing annulus. When cementing from the top of the casing, it is often difficult to ensure the entire annulus is cemented.

For these reasons, staged cementing operations can be performed in which different sections (i.e., stages) of the wellbore's annulus are filled with cement. To do such staged operations, various stage tools can be disposed on the tubing string in the casing for circulating cement slurry pumped down the tubing string into the wellbore annulus at particular locations.

As an example, FIG. 1A illustrates an assembly according to the prior art having a stage tool 24 and a packer 22 on a casing string or liner 20 disposed in a wellbore 10. The stage tool 24 allows the casing string 20 to be cemented in the wellbore 10 using the two or more stages. In this way, the stage tool 24 and staged cementation operations can be used for zones in the wellbore 10 experiencing lost circulation, water pressure, low formation pressure, and high-pressure gas.

As shown, an annulus casing packer 22 can be run in conjunction with the stage tool 24 to assist cementing of the casing string 20 in two or more stages. The stage tool 24 is typically run above the packer 22, allowing the lower zones of the wellbore 10 to remain uncemented and to prevent cement from falling downhole. One type of suitable packer 22 is Weatherford's BULLDOG ACP™ annulus casing packer. (ACP is registered trademarks of Weatherford/Lamb, Inc.)

Other than in a vertical bore as shown in FIG. 1A, stage tools can be used in other implementations. For example, FIG. 1B illustrates a casing string 20 having a stage tool 24 and a packer 20 disposed in a deviated wellbore. As also shown, the assembly can have a slotted screen 26 below the packer 22.

Two main types of stage tools are used for cementing operations. Hydraulic stage tools are operated hydraulically using plugs. Although hydraulic operation can decrease the time required to function the stage tools, the seats and plugs in these stage tools need to be drilled out. The other type of stage tool is a mechanical port collar, which does not require drill-out. However, these mechanical collars require a more complex operation that uses a workstring to function the collars.

FIG. 2 illustrates a mechanical cement port tool 30 according to the prior art in partial cross-section. The tool 30 is run on casing string (not shown) and includes a housing 32 with a through-bore 34. Exit ports 36 communicate cement slurry from the through-bore 34 into a wellbore annulus during cementing operations. To open and close flow, a mechanically shifted sleeve 40 is disposed in the through-bore 34 and can be moved relative to the exit ports 36 to close and open communication therethrough. In the closed position shown, seals 46 on the sleeve 40 seal off the exit ports 36, and a lock ring 45 rests in a lower profile 35 of the housing's through-bore 34.

The sleeve 40 has upper and lower profiles 48*a-b* used to shift the sleeve mechanically with a shifting tool 50, such as shown in FIG. 3. The shifting tool 50 has a body 54 that couples to a workstring 52. Engagement profiles 58, such as B-profiles, on the outside of the body 58 can engage in the sleeve's profiles 48*a-b* so that mechanical manipulation of the workstring 52 can manipulate the sleeve 40.

Currently, when doing a two stage cementing application, the inner string 52 is used to manipulate the mechanical port collar's sleeve 40 to allow the ports 36 to be exposed to the annulus so cement slurry can be pumped out of the collar 30. This requires extra rig time to run the workstring 52 in the hole, function the collar 30, and come out of the hole with the workstring 52.

For example, FIG. 4A shows an example of the port collar 30 as it is run in the hole. The mechanical port collar 30 is made up and run in the well on either the casing or liner. Shown in the closed position, the sleeve 40 closes off the collar's ports 36. The collar 30 is a full-bore cementing valve that is opened and closed with axial workstring movement and requires no drill-out after use. Therefore, plugs or seats are not needed inside the collar 30, which leave the internal dimension clean of excess cement after closure.

The internal sleeve 40 is opened and closed by engaging the collet-shifting tool 54 made up on the workstring 52. The tool 54 is usually placed between opposed cups (not shown) on a service tool 50.

In FIG. 4B, the shifting tool 50 is manipulated uphole by the workstring 52 to open the collar's sleeve 40 relative to the port 36. When the shifting tool 50 is moved and the collets engage the sleeve's profile 48*b*, the sleeve 40 can shift to the open position. When the sleeve 40 is open, a primary cement job can be performed by pumping down the workstring 52, out the service tool 54, through the open port collar 30, and into the annulus around the casing or liner.

Finally, as shown in FIG. 4C, the shifting tool 50 manipulated downhole by the workstring 52 can shift the port collar's sleeve 40 closed, which may be subsequently locked in place. On completion of the cement job, for example, axial movement of the tool 50 closes the sleeve 40 and seals the port collar 30 closed. The service tool 50 is then retrieved from the well, leaving the internal dimension of the port collar 30 full-bore to the casing or liner and free from of cement and other debris.

In deviated holes, the workstring 52 and shifting tool 50 may not actually manipulate the sleeve 40 open or closed inside the mechanical port collar 30. In fact, to function properly, the mechanical port collar 30 can require the workstring 52 to locate the shifting tool 50 at a certain point in the collar 30. Typically, operators determine proper location of the shifting tool 50 on the rig floor using force indications on a weight indicator. This may not always be effective. Therefore, being able to open and close a mechanical port collar without needing to particularly locate a workstring and shifting tool would be of great value to cement operations.

The subject matter of the present disclosure is directed to overcoming, or at least reducing the effects of, one or more of the problems set forth above.

SUMMARY OF THE DISCLOSURE

A port collar for use on casing in a borehole has a housing with an internal bore. At least one exit port on the housing communicates the internal bore with the borehole so cement slurry or the like can be communicated to the borehole annulus. An opening valve or sleeve disposed on the housing is biased from a closed position to an opened position relative to the at least one exit port, and a first restraint temporarily holds the opening valve in the closed position. At the same time, a closing valve or sleeve disposed on the housing is biased from an opened position to a closed position, and a second restraint temporarily holding the closing valve in the opened position. The valves can be concentrically arranged sleeves and can be biased by biasing members, such as springs, or the valves can be biased by contained pressure or other form of biasing.

During a cementing operation, the first restraint is electronically activated with a first trigger to release the opening sleeve to the opened position when activated. With the opening sleeve open, cement slurry can pass out of the collar's exit port to the borehole annulus. When cementing is completed, the second restraint is electronically activated with a second trigger to release the closing sleeve to the closed position when activated. This closes the collar to the borehole so the cement can set.

The collar can include an electronic controller operatively connected to the first and second restraints. For example, the restraints can include bands, strips, filaments, or the like held in tension and holding the sleeves in biased position. Fuses connected to the restraints can activate the restraints (by burning, cutting, breaking, etc. them) in response to the triggers.

The controller can have an antenna, battery, and electronics and can generate the necessary triggers in response to passage of at least one RFID tag. Alternatively, the controller can have other types of detectors or sensors, such as a pressure sensor, telemetry sensor, etc. In general, the controller can generate the triggers in response to passage of one or more RFID tags, a pressure pulse, chemical tracer, a radioactive tracer, etc.

In one arrangement, electric fuses burn through a string of reinforcement material, such as synthetic fiber, which holds back the biased sleeves. The collar is run in the hole in the closed position above the packer as normal. The controller located in a subassembly connected to the port collar can house an antenna, electronics, the fuses, and other necessary components. Once the cementing process is ready, an RFID tag in a dart or plug is dropped down the casing string in advance of the cement slurry.

Once the tag passes the port collar's controller, the controller activates and burns the first restraint. In turn, the opening sleeve associated with this first string shifts open and aligns its port holes with the collar's exit ports so the cement slurry can be pumped to the borehole annulus. Once cementing is complete, another RFID can be pumped or dropped down the casing string, or a particular timing sequence may be used. Either way, the controller burns through another restraint associated with the separate, closing sleeve to close off the ports. Once again this closing sleeve moves closed, and a locking feature on at least one of the sleeve prevents any further movement, thus locking the collar closed.

Using the electronically-actuated port collar, the time required to open and close the port collar by running an inner string in and out of the casing can be avoided. Additionally, because there is no more need to locate grooves for mechanically manipulating the port collar. If need be, however, a secondary system that allows the port collar to be operated with mechanical movement can also be used.

The foregoing summary is not intended to summarize each potential embodiment or every aspect of the present disclosure.

DETAILED DESCRIPTION OF THE DISCLOSURE

Figure 1A:
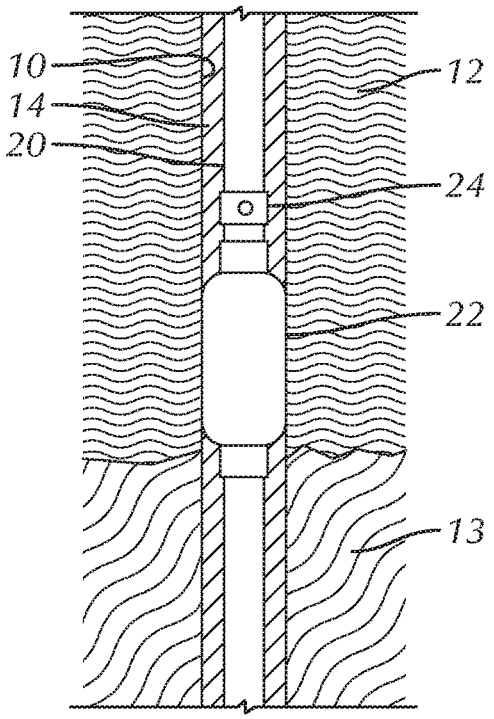
FIG. 1A (Prior Art)
FIG. 1A illustrates an assembly according to the prior art having a stage tool and a packer disposed in a vertical wellbore.
Figure 1B:
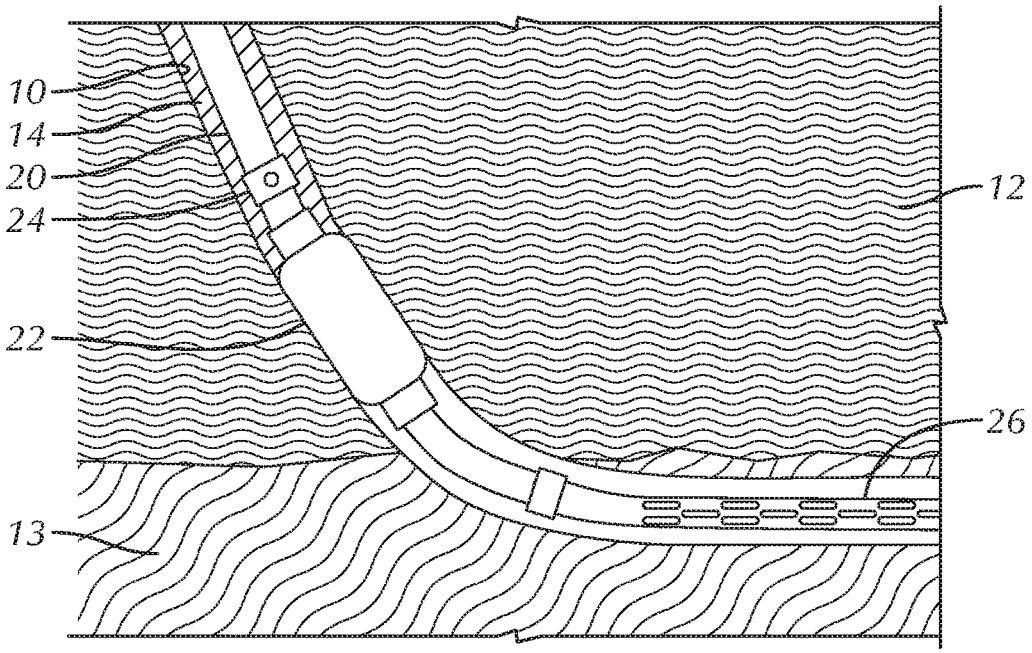
FIG. 1B (Prior Art)
FIG. 1B illustrates an assembly according to the prior art having a stage tool and a packer disposed in a deviated wellbore.
Figure 2:
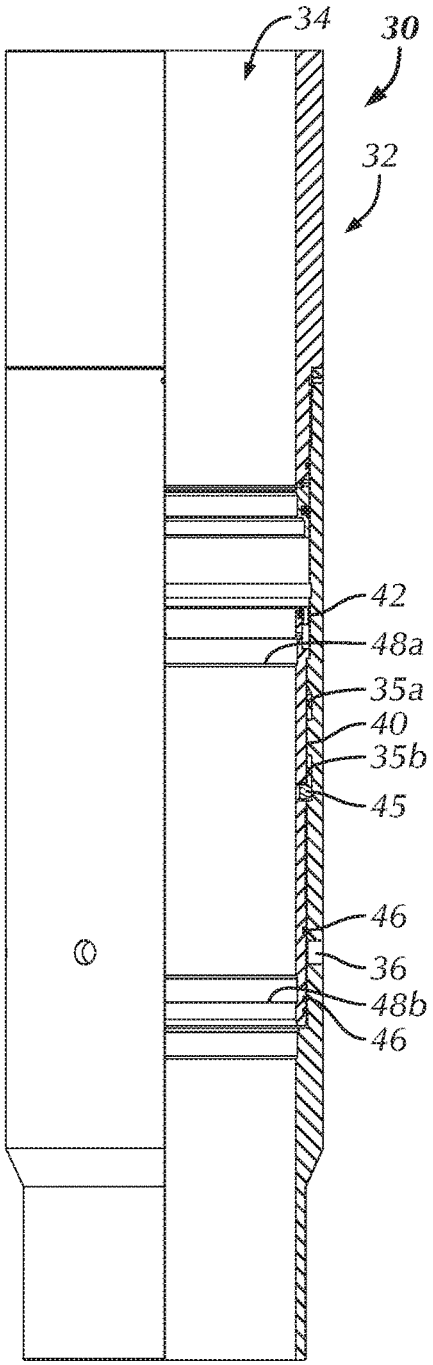
FIG. 2 (Prior Art)
FIG. 2 illustrates a mechanical cement port tool according to the prior art in partial cross-section.
Figure 3:
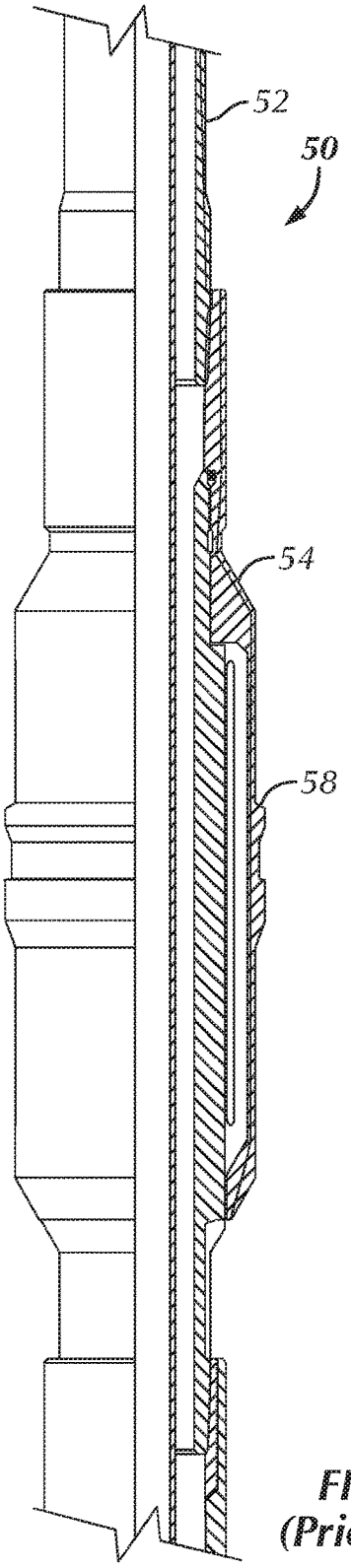
FIG. 3 (Prior Art)
FIG. 3 illustrates a shifting tool according to the prior art.
Figure 4A:
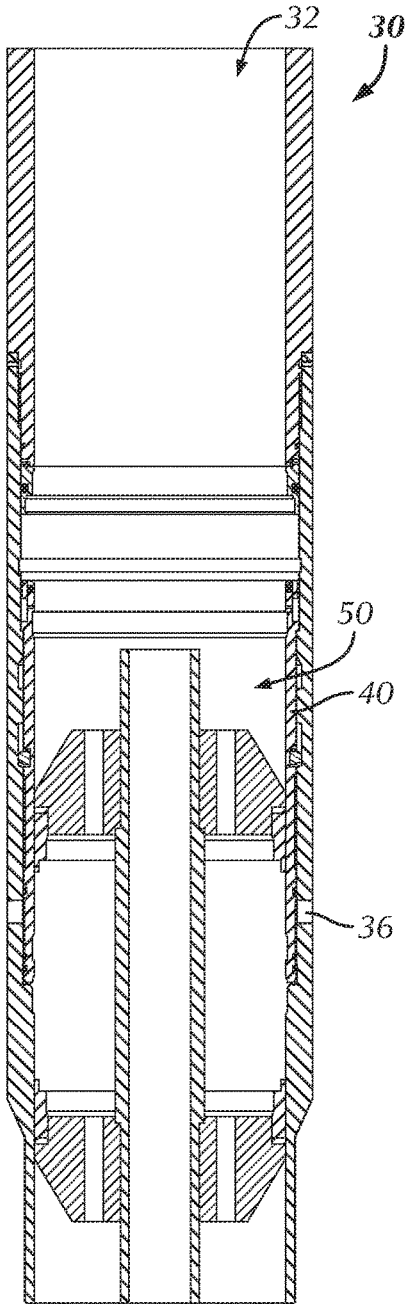
FIG. 4A (Prior Art)
FIGS. 4A-4C illustrate operation of the prior art port collar and shifting tool.
Figure 4B:
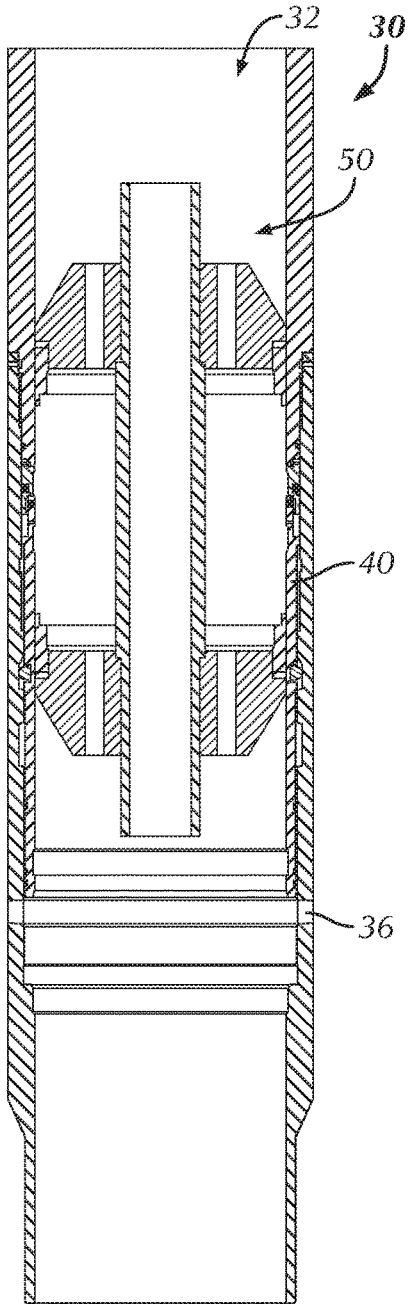
FIG. 4B (Prior Art)
Figure 4C:
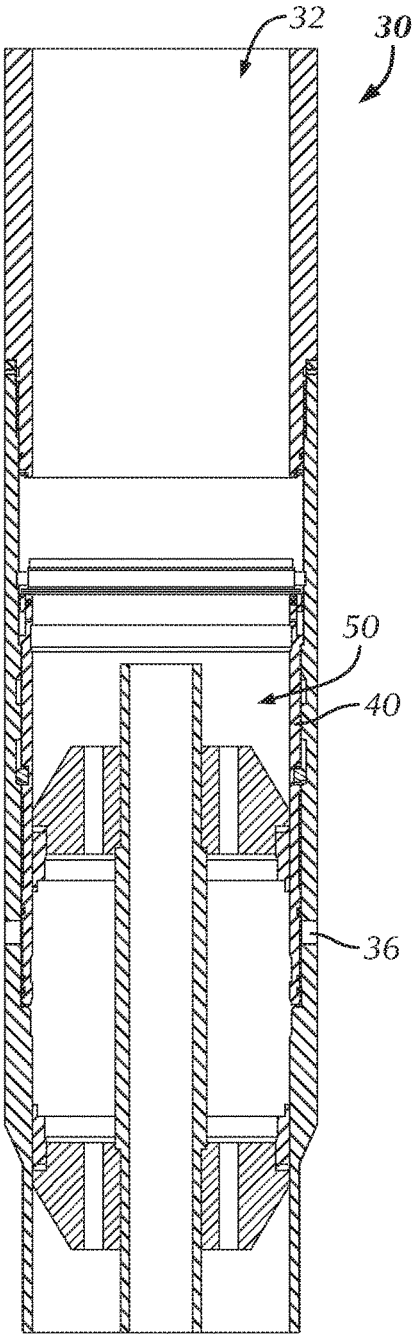
FIG. 4C (Prior Art)
Figure 5:
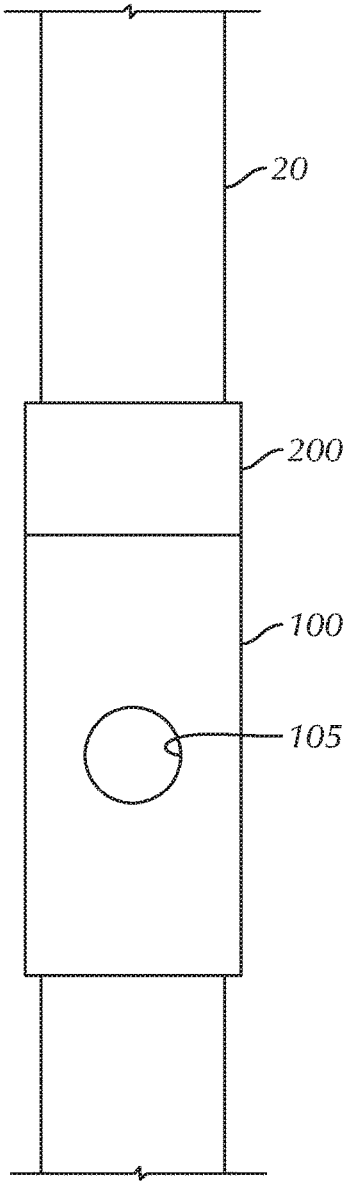
FIG. 5 diagrammatically illustrates an electronically-actuated port collar according to the present disclosure.

FIG. 5 diagrammatically illustrates an electronically-actuated port collar 100 according to the present disclosure. The collar 100 includes a controller 200 associated with it on casing 20, liner, or the like. The collar 100 has one or more exit ports 105 that can be selectively opened and closed to complete staged cementing operations of the casing 20 in a wellbore (not shown), and the controller 200 actuates the opening and closing of the port collar 100 as described in detail below.

Figure 6A:
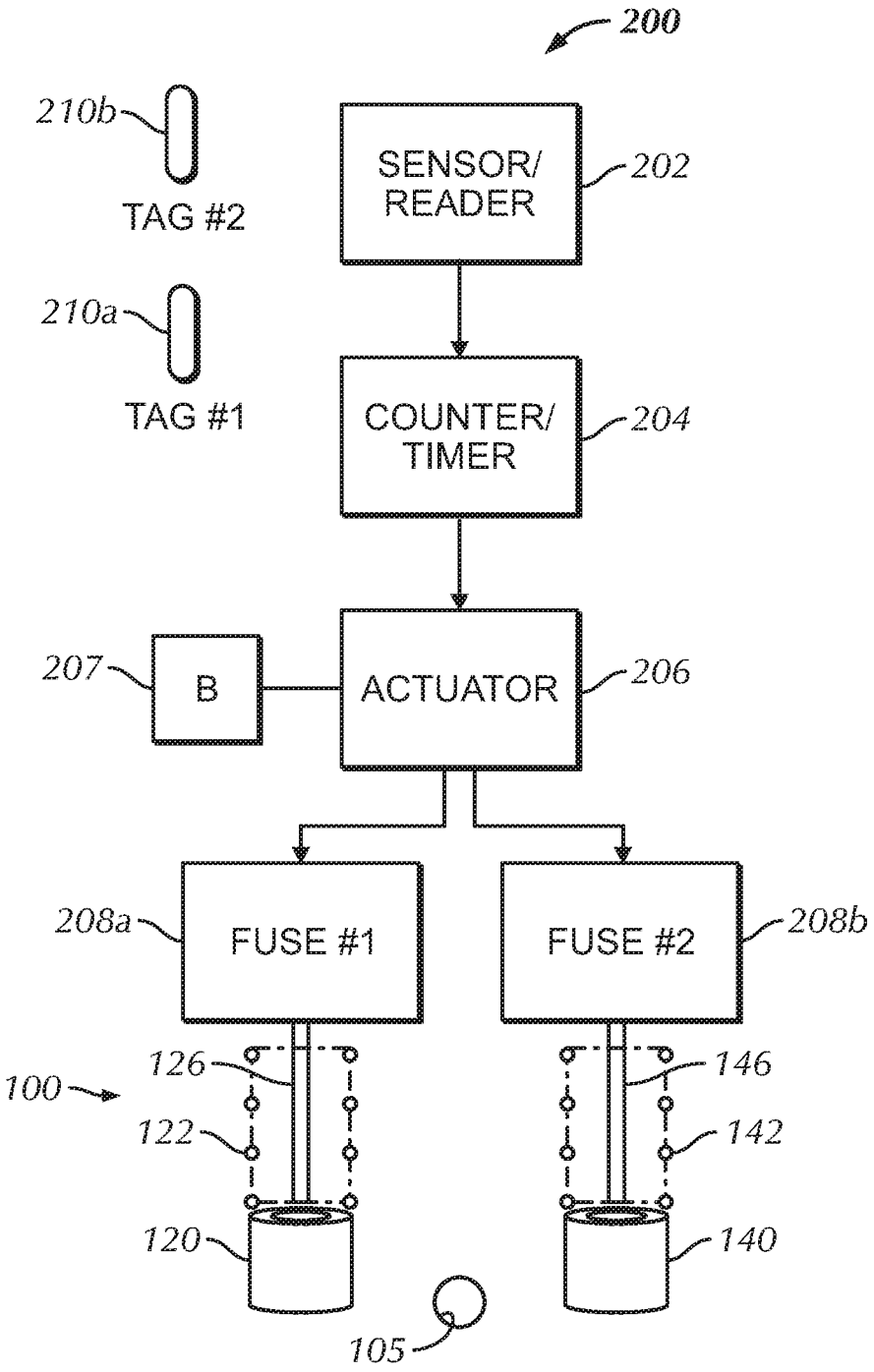
FIG. 6A diagrammatically illustrates a controller for the electronically-actuated port collar.

As diagrammatically illustrated in FIG. 6A, the controller 200 for the electronically-actuated port collar 100 can include a detector, sensor, or reader 202; a counter, timer or other logic 204; an actuator 206; a power source or battery 207; and fuses 208*a-b*. In response to various activations or triggers sensed by the sensor 202, the actuator 206 actuates one or the other of the two or more electric fuses 208*a-b* to open and close the port collar 100—some of the components of which are also diagrammed in FIG. 6A.

In particular, actuating of one fuse 208*a* opens the port collar 100 to allow cement slurry to flow out the collar's ports 105. For example, a first opening valve or sleeve 120 of the port collar 100 moves open relative to the collar's ports 105 by bias 122 (e.g., spring) when a restraint 126 is burned, broken, cut, ruptured, or the like. At a later point in time, subsequent actuation of the other fuse 208*b* closes the port collar 100 to seal off the casing string from the annulus. For example, a second closing valve or sleeve 140 of the port collar moves closed relative to the collar's ports 105 by bias 142 (e.g., spring) when a restraint 146 is burned, broken, cut, ruptured, or the like.

Various types of detectors, sensors, or readers 202 can be used, including, but not limited to, a radio frequency identification (RFID) reader, sensor, or antenna; a Hall Effect sensor; a pressure sensor; a telemetry sensor; a radioactive trace detector; a chemical detector; and the like. For example, the controller 200 can be activated with any number of techniques—e.g., RFID tags in the flow stream may be used alone or with plugs; chemicals and/or radioactive tracers may be used in the flow stream; mud pressure pulses (if the system is closed chamber, e.g. cement bridges off in the annular area between the casing OD and borehole ID); mud pulses (if the system is actively flowing); etc.

As an alternative to RFID, for example, the controller 200 can be configured to receive mud pulses from the surface or may include an electromagnetic (EM) or an acoustic telemetry system, which include a receiver or a transceiver (not shown). An example of an EM telemetry system is discussed in U.S. Pat. No. 6,736,210, which is hereby incorporated by reference in its entirety.

Commands and information can be sent to the controller 200 using one or more of the above techniques. For example, the command to "open" the port collar 100 may be telemetered by a different medium than the command to "close" the port collar 100. In other words, the "open" command may be conveyed via pressure pulses, and the "close" command may be conveyed via passage of an RFID tag. This versatility is useful for incorporating back-up systems in the port collar 100 so if one command method fails, another may be used.

Additionally, such versatility is useful for situations in which circulation paths are available only some of the time. For instance, a circulation path may not be available before opening the port collar 100 so commands to the controller 200 can use pressure pulses. When there is a circulation path after opening the port collar 100, then commands to the controller 200 can use RFID tags. Alternatively, the "open" command may actually be a timed command using pressure pulses to open the port collar 100, at which point the controller 200 can wait a preset time period (e.g., 2 hours) and then automatically close the port collar 100. These and other alternatives will be appreciated with the benefit of the present disclosure.

For the purposes of the present disclosure, reference to the controller 200 and the sensor 202 will be to an RFID based system, which may be preferred in some instances. As will be appreciated, the sensor 202 can be an RFID reader that uses radio waves to receive information (e.g., data and commands) from one or more electronic RFID tags 210*a-b*. The information is stored electronically, and the RFID tags 210*a-b* can be read at a distance from the reader 202. To convey the information to the collar 100 at a given time during operations, the RFID tags 210*a-b* are inserted into the casing at surface level and are carried downhole in the fluid stream of cement slurry or the like. When the tags 210*a-b* come into proximity to the collar 100, the electronic reader 202 on the tool's controller 200 interprets instructions embedded in the tags 210*a-b* to perform a required operation.

The logic 204 of the controller 200 can count triggers, such as the passage of a particular RFID tag 210*a* or 210*b*, a number of RFID tags 210*a-b*, or the like. In addition and as an alternative, the logic 204 can use a timer to actuate the actuator 206 after a period of time has passed since a detected trigger (e.g., passage of an RFID tag 210*a* or 210*b*). These and other logical controls can be used by the controller 200.

For its part, the actuator 206 is suitable for the type of fuses 208*a-b* used. In one example, the fuses 208*a-b* burn the restraints 126 and 146, which are strands, bands, filaments, or the like composed of a reinforcement material, such as a synthetic fiber (e.g., Kevlar), metal, composite, or other type of material. In one arrangement, the actuator 206 includes one or more switches, coils, charges, or other electronics for directing power from the battery or other power source 207 to the electronic fuses 208*a-b* so they can burn, heat, melt, etc. the restraints 126 and 146. In general, the restraints 126 and 146 are breakable members in the sense that they can be burned, melted, broken, cut, fractured, etc.

The restraints 126 and 146 initially hold tension to keep the biased valves or sleeves 120 and 140 of the port collar 100 in place. For example, the restraints 126 and 146 can be bands, strands, fibers, etc. that resist longitudinal tension. Accordingly, the restraints 126 and 146 can have one end affixed to the port collar 100 and can have another end affixed to either the sleeves 120 and 140, the spring 122 and 142, or both. Once burned, broken, etc., the restraints 126 and 146 lose their tensile hold and can release the stored bias for opening and closing the valves or sleeves 120 and 140 on the port collar 100.

As an alternative to holding tension, the restraint 126 and 146 can hold compressive loads opposing the bias of the springs 122 and 142. For example, the restraints 126 and 146 can be rigid members that resist longitudinal compression. Accordingly, the restraints 126 and 146 can have one end affixed to the port collar 100 and can have another end affixed to either the valve or sleeves 120 and 140, the spring 122 and 142, or both. Once burned, broken, etc., the restraints 126 and 146 lose their compressive hold and can release the stored bias for opening and closing the valves or sleeves 120 and 140 on the port collar 100.

As can be seen, using stored bias in springs 122 and 142 to move the sleeves 120 and 140 and restraining that bias with restraints 126 and 146 are preferred. It will be appreciated with the benefit of the present disclosure that the actuator 206 can include any suitable mechanism for moving the sleeves 120 and 140, including, but not limited to, hydraulic pumps, motors, solenoids, and the like. Accordingly, the port collar 100 disclosed herein can be implemented with a controller 200 having actuators 206 similar to these in which can use of the bias springs 122 and 142 and restraints 126 and 146 may be replaced with components associated with such alternative means of moving the sleeves 120 and 140.

Figure 6B:
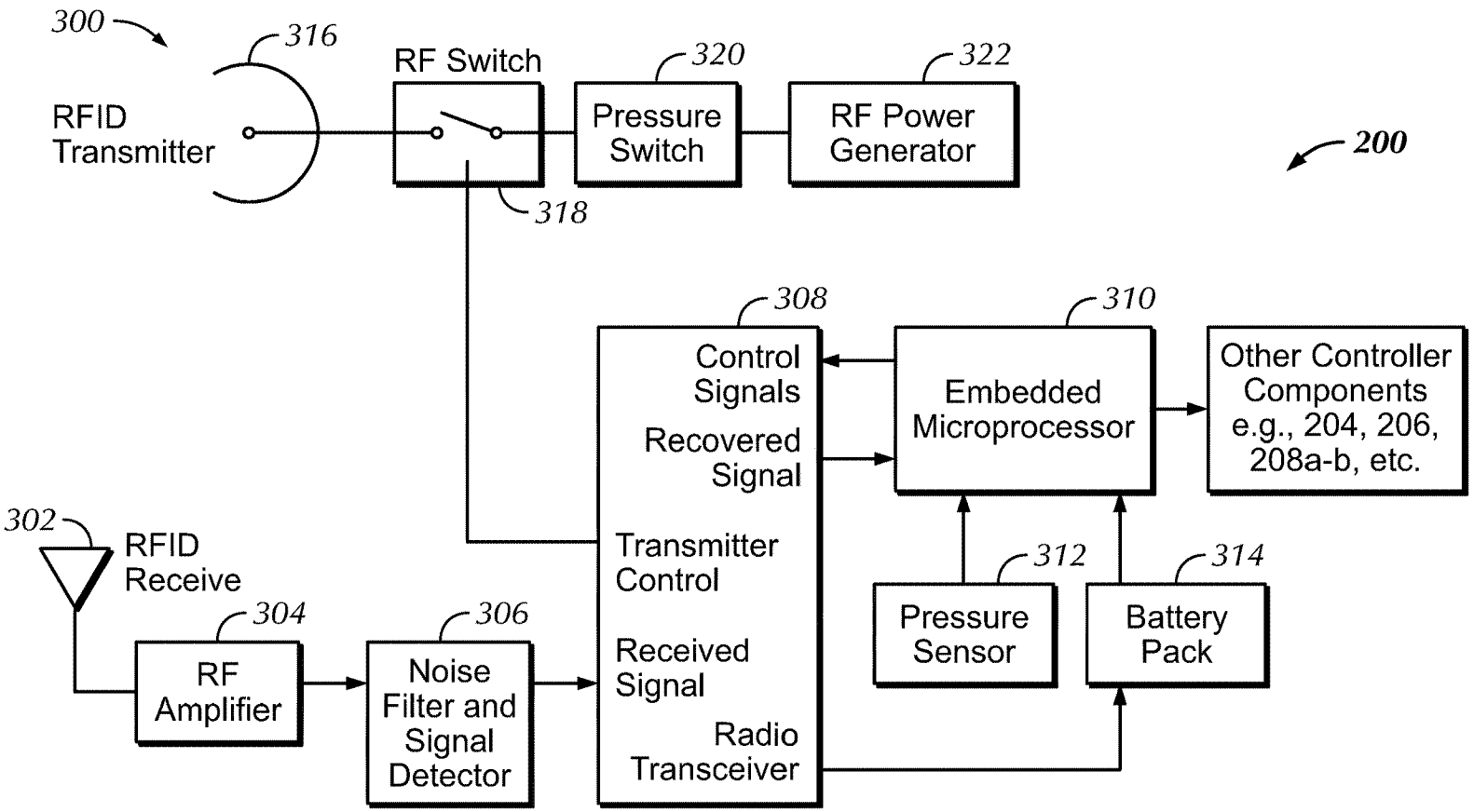
FIG. 6B illustrates an embodiment of a radio-frequency identification (RFID) electronics package for the disclosed controller.
Figure 6C:
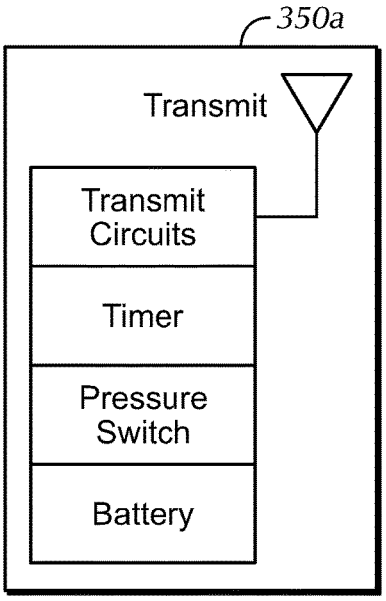
FIGS. 6C-6D illustrate an active RFID tag and a passive RFID tag, respectively.
Figure 6D:
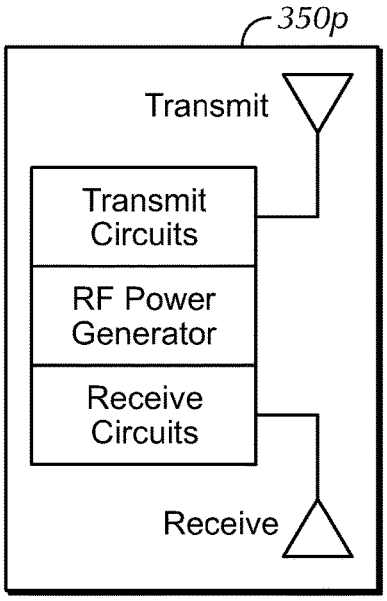

Further details of the controller 200 are shown in FIG. 6B, which illustrates a radio-frequency identification (RFID) electronics package 300 for the RFID sensor 202 and other components of the controller 200. In general, the electronics package 300 may communicate with an active RFID tag 350*a* (FIG. 6C) or a passive RFID tag 350*p* (FIG. 6D) depending on the implementation. Briefly, the active RFID tag 350*a* (FIG. 6C) includes a battery, pressure switch, timer, and transmit circuits. By contrast, the passive RFID tag 350*p* (FIG. 6D) includes receive circuits, RF power generator, and transmit circuits. In use, either of the RFID tags 350*a-p* may be individually encased and dropped or pumped through the casing string as noted herein. Alternatively, either of the RFID tags 350*a-p* may be embedded in a ball (not shown) for seating in a ball seat of a tool, a plug, a bar, or some other device used to convey the tag 350*a-p* and/or to initiate action of a downhole tool.

The RFID electronics package 300 includes a receiver 302, an amplifier 304, a filter and detector 306, a transceiver 308, a microprocessor 310, a pressure sensor 312, a battery pack 314, a transmitter 316, an RF switch 318, a pressure switch 320, and an RF field generator 322. Some of these components (e.g., microprocessor 310 and battery 314) can be shared with the other components of the controller 200 described herein.

If a passive tag 350*p* is used, the pressure switch 320 closes once the port collar 100 is deployed to a sufficient depth in the wellbore. The pressure switch 320 may remain open at the surface to prevent the electronics package 300 from becoming an ignition source. The microprocessor 310 may also detect deployment in the wellbore using the pressure sensor 312. Either way, the microprocessor 310 may delay activation of the transmitter 316 for a predetermined period of time to conserve the battery pack 314.

Once configured, the microprocessor 310 can begin transmitting a signal and listening for a response. Once a passive tag 350*p* is deployed into proximity of the transmitter 316, the passive tag 350*p* receives the transmitted signal, converts the signal to electricity, and transmits a response signal. In turn, the electronics package 300 receives the response signal via the antenna 302 and then amplifies, filters, demodulates, and analyzes the signal. If the signal matches a predetermined instruction signal, then the microprocessor 310 may activate an appropriate function on the collar 100, such as energizing a fuse, starting a timer, etc. The instruction signal carried by the tag 350*a-p* may include an address of a tool (if the casing string includes multiple collars or other tools, packers, sleeves, valves, etc.), a set position (if the tools are adjustable), a command or operation to perform, and other necessary in formation.

If an active RFID tag 350*a* is used, the transmission components 316-322 may be omitted from the electronics package 300. Instead, the active tag 350*a* can include its own battery, pressure switch, and timer as noted previously so that the tag 350*a* may perform the function of the components 316-322.

Further, either of the tags 350*a-p* can include a memory unit (not shown) so that the microprocessor 310 can send a signal to the tag 350*a-p* and the tag 350*a-p* can record the data, which can then be read at the surface. In this way, the recorded data can confirm that a previous action has been carried out. The data written to the RFID tag 350*a-p* may include a date/time stamp, a set position (the command), a measured position (of control module position piston), and a tool address. The written RFID tag may be circulated to the surface via the annulus, although this may not be practical in cementing operations.

Ultimately, once the microprocessor 310 detects one of the RFID tags 350*a-p* with the correct instruction signal, the microprocessor 310 can control operation of the other controller components disclosed herein, such as discussed previously with reference to FIG. 6A.

Figure 7A:
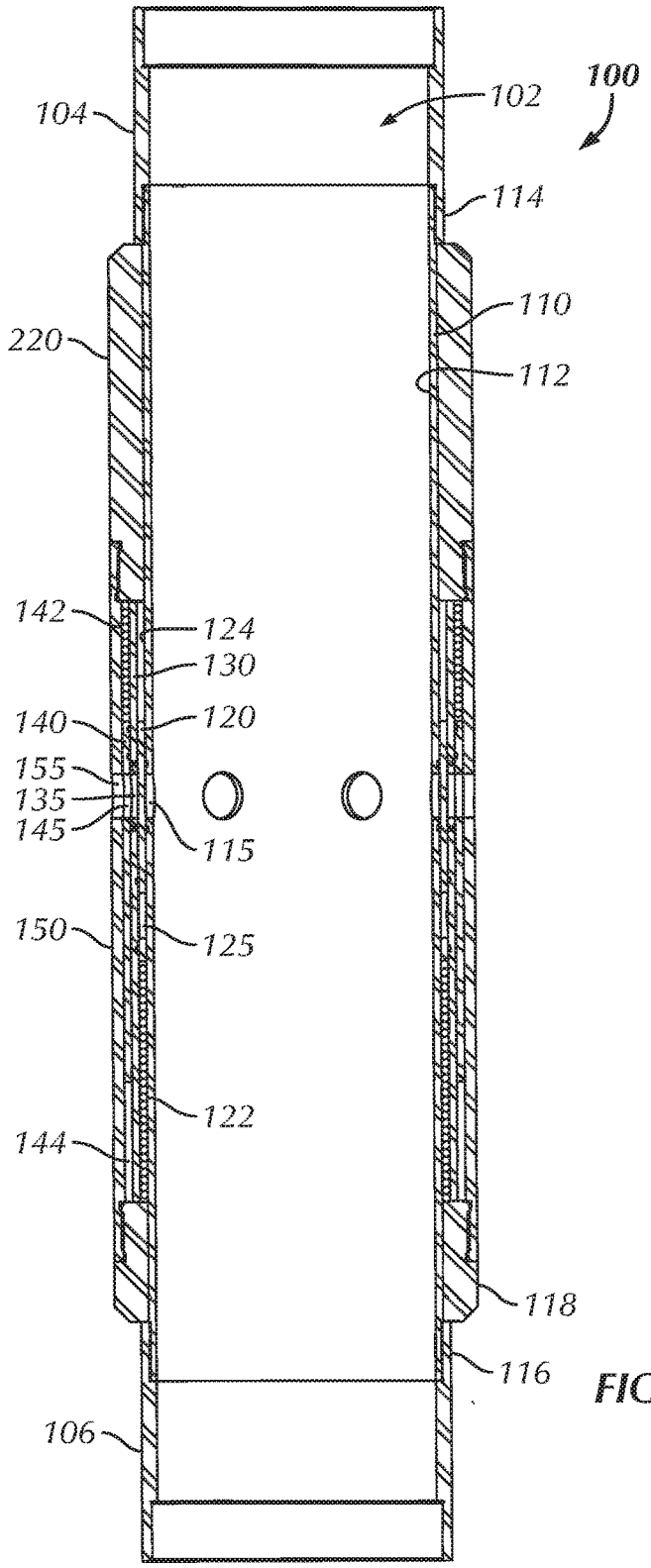
FIG. 7A illustrate a cross-sectional view of an electronically-actuated port collar according to the present disclosure.
Figure 7B:
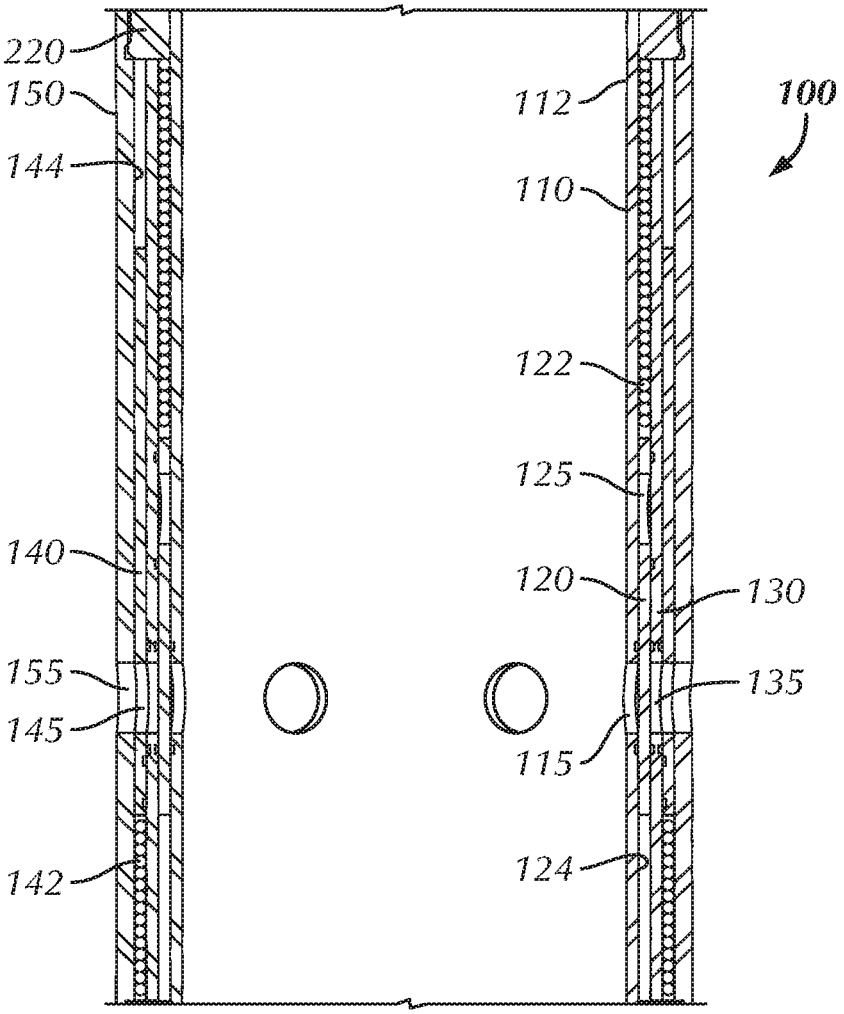
FIG. 7B illustrates a detail of FIG. 7A.

With an understanding of the overall system of the port collar 100 and the controller 200, discussion turns to FIGS. 7A and 7B, which illustrate cross-sectional views of an electronically-actuated port collar 100 according to the present disclosure. The port collar 100 defines a bore 102 therethrough that is roughly uniform and has an internal diameter roughly equal to the casing to which the collar 100 couples. An inner mandrel 110 of the port collar 100 has connector ends 104 and 106 for affixing the port collar 100 to the casing using conventional techniques. Disposed on the mandrel 110 are an end ring 118, a controller housing 220, and various valves, sleeves, and mandrels 120, 130, 140, and 150—some of which move relative to the others.

To communicate cement slurry out of the collar's bore 102, the inner mandrel 110 includes one or more exit ports 115. As best shown in FIG. 7B, an opening valve 120 in the form of a sleeve fits concentrically outside the inner mandrel 110. This opening sleeve 120 has its own ports 125 and can move relative to the exit ports 115 on the inner mandrel 110. In the closed position depicted, the opening sleeve 120 has a biasing member or spring 122 held in compression and has a space 124 for eventual travel of the sleeve 120. Other forms of biasing can be used on the sleeve 120, such as a closed chamber containing pressure, a spring held in distention, etc. As noted previously, a restraint (126; not visible) maintains the opening sleeve 120 closed.

An intermediate sleeve or mandrel 130 fits outside the opening sleeve 120 and has its own ports 135, which are aligned with the inner mandrel's exit ports 115. This intermediate mandrel 130 does not move and is held between the end ring 118 and the controller's housing 220. It also includes various seals on both sides surrounding its ports 135 for sealing.

A closing valve 140 in the form of a sleeve fits concentrically outside the intermediate mandrel 130. This closing sleeve 140 also has its own ports 145 and can move relative to the ports 115/135 on the mandrels 110 and 130. In the opened position depicted, the closing sleeve 140 has a biasing member or spring 142 held in compression and has a space 144 for eventual travel of the sleeve 140. Again, other forms of biasing can be used on the sleeve 140, such as a closed chamber containing pressure, a spring held in distention, etc. As noted previously, a restraint (146; not visible) maintains the closing sleeve 140 opened.

Finally, an external sleeve or mandrel 150 fits outside the closing sleeve 140 and has its own ports 155, which are aligned with the inner mandrel's exit ports 115. This external mandrel 150 does not move and is held between the end ring 118 and the controller's housing 220. It also includes various seals on the inside surrounding its ports 155 for sealing purposes. The concentrically arranged sleeves 120 and 140 and mandrels 110, 130, and 150 are used to facilitate assembly of the collar 100 and to accommodate the cylindrical arrangement and multiple exit ports 115. Although such an arrangement may be preferred, the collar 100 can have the valves 120 and 140 in different configurations, such as pistons or rods. In fact, each exit port 115 can have its own valves 120 and 140.

Figure 8A:
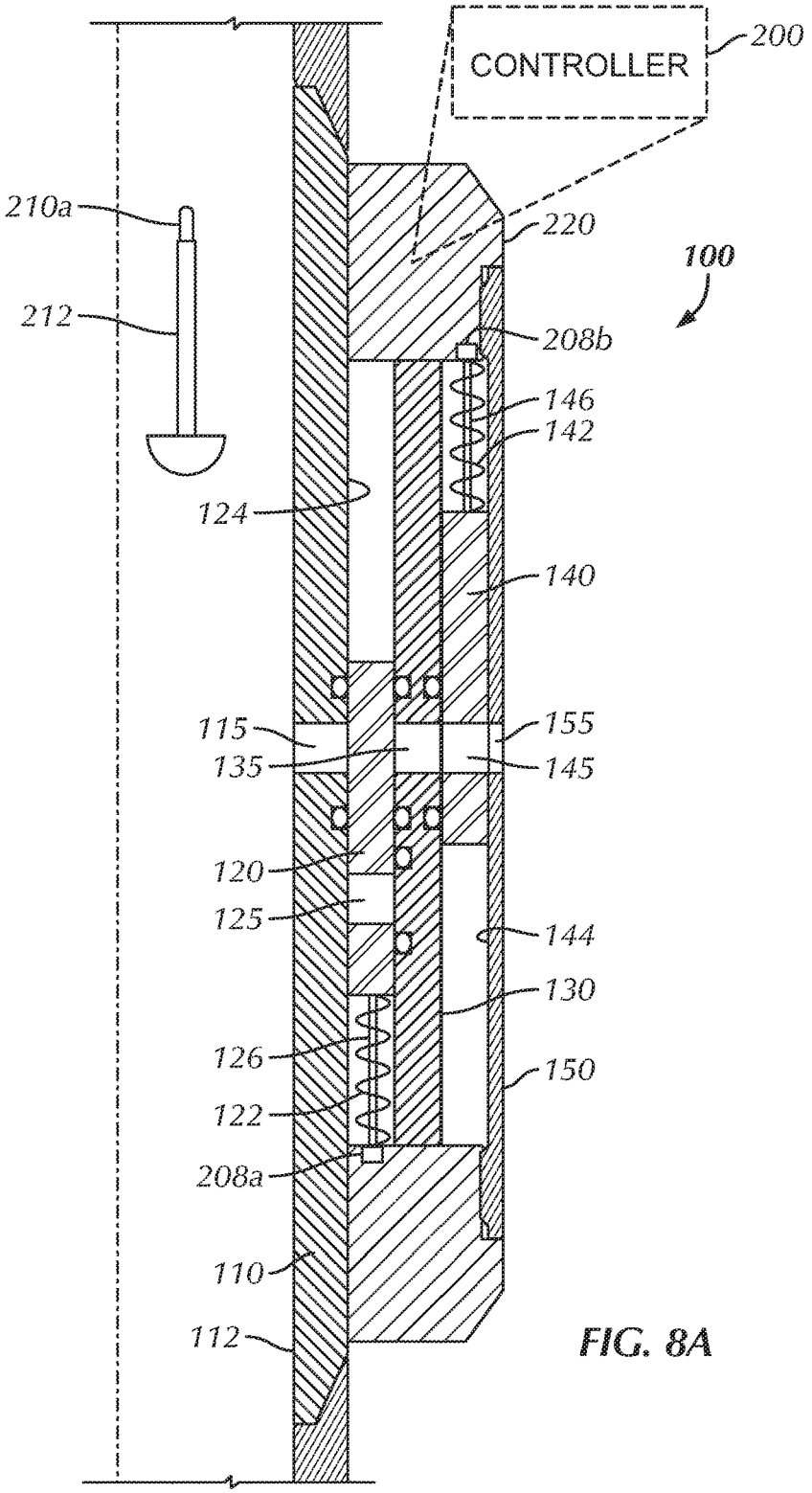
FIGS. 8A-8C diagrammatically illustrates operation of the electronically-actuated port collar.
Figure 8B:
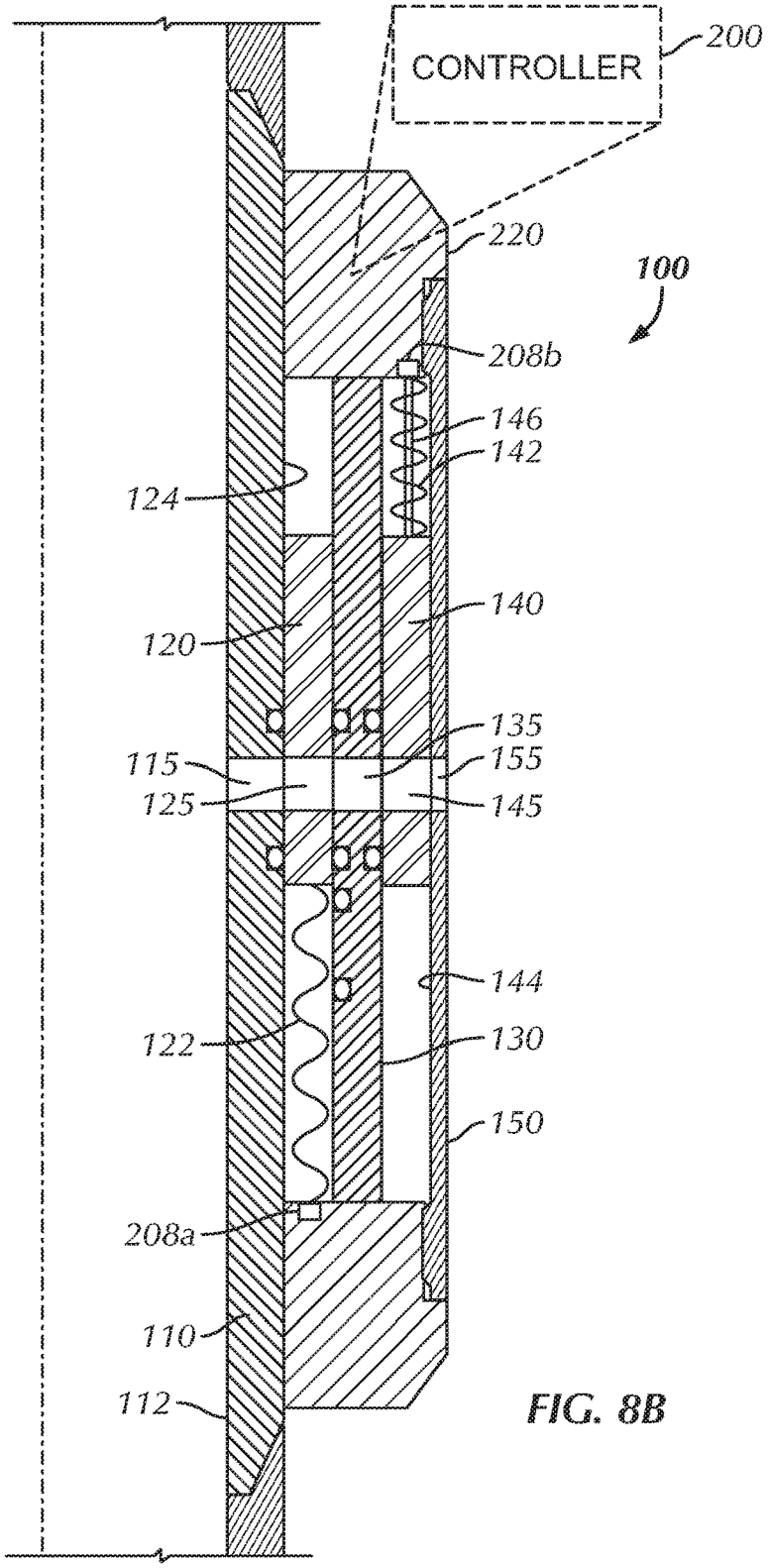
Figure 8C:
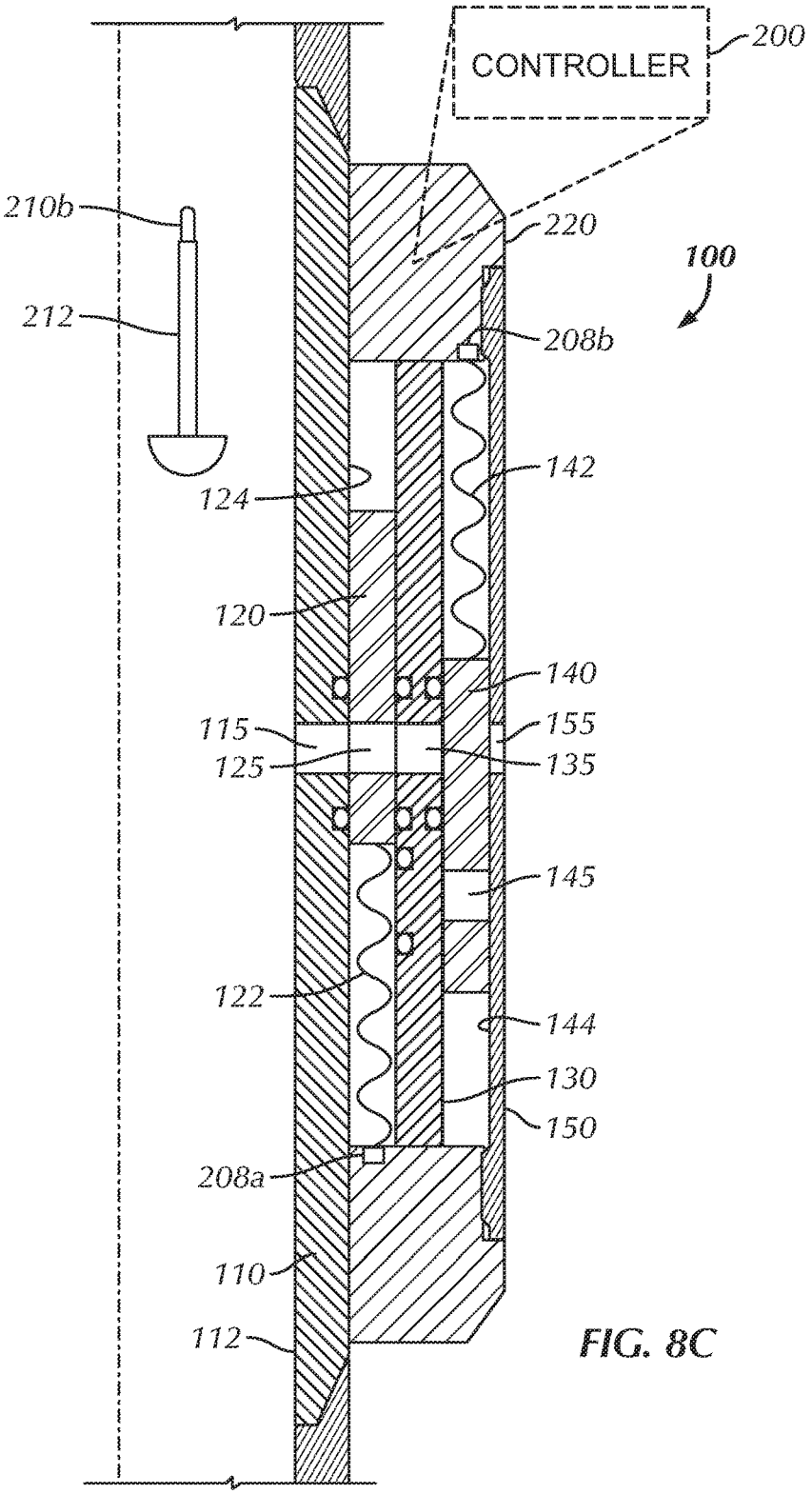

Operation of the electronically-actuated port collar 100 is best shown with reference to FIGS. 8A-8C. When run-in on the casing string, the collar 100 has a closed condition in which the opening sleeve 120 is held closed by one or more first restraints 126, such as a fiber band noted previously. Similarly, the closing sleeve 140 is held opened by one or more second restraints 146, such as a fiber band noted previously. Thus, full communication from the tool's bore 102 to the annulus is prevented by the opening sleeve 120.

Once the casing is positioned and cementing operations are to begin at the collar 100, operators then actuate the port collar 100 in an opening operation. For example, a first RFID tag 210*a* affixed to a directing dart 212 or the like is deployed down the casing in the fluid stream. In reality, several similar tags 210*a* can dropped at the same time for redundancy. In any event, the controller 200 detects passage of one of the RFID tags 210*a* and actuates the first fuse (208*a*) to burn the first restraint 126 holding the opening sleeve 120 closed.

When the restraint 126 loses its tensile hold, the bias of the compressed spring 122 shifts the sleeve 120 to its opened position in the provided space 122. The sleeve's ports 125 are then aligned with all of the other ports 115, 135, and 145 as shown in FIG. 8B. Although not shown, lock rings, catches, and the like can be used to further hold the sleeve 120 open. With the port collar 100 open, cementing operations can be performed with the cement slurry able to pass out the aligned ports 115, 125, 135, and 145 of the collar 100 and into the surrounding wellbore annulus.

Eventually, operators will need to close the port collar 100 so the cement slurry can be closed off in the wellbore annulus and allowed to set. To do this, operators then actuate the port collar 100 in a closing operation. As shown in FIG. 8C, for example, one or more second RFID tags 210*b* affixed to directing darts 212 or the like can be deployed down the casing in the fluid stream. Alternatively, the controller 200 may use timing logic to actuate after a defined period of time from the passage of the first tag 210*a*. In any event, the controller 200 actuates the second fuse (208*b*) to burn the second restraint 146 holding the closing sleeve 140 opened.

When the restraint 146 loses its tensile hold, the bias of the compressed spring 142 shifts the sleeve 140 to its closed position in the provided space 142, as shown in FIG. 8C. In this condition, the sleeve's ports 145 no longer align with all of the other ports 115, 125, and 135. Although not shown, lock rings, catches, and the like can be used to further hold the sleeve 140 open.

Because the controller 200 can be programmed to read particular tags 210, the controller 200 can ignore the passage of tags 210 deployed down the flow stream that are intended for other port collars 100 or other tools uphole or downhole on the casing. Although the tags 210 are shown used with directing darts 212, the tags 210 can be used with any other suitable objects for deployment in the casing string, including balls, darts, plugs, wipers, and the like, depending on what additional actions are needed to be performed along the casing string during cementing operations.

Figure 9:
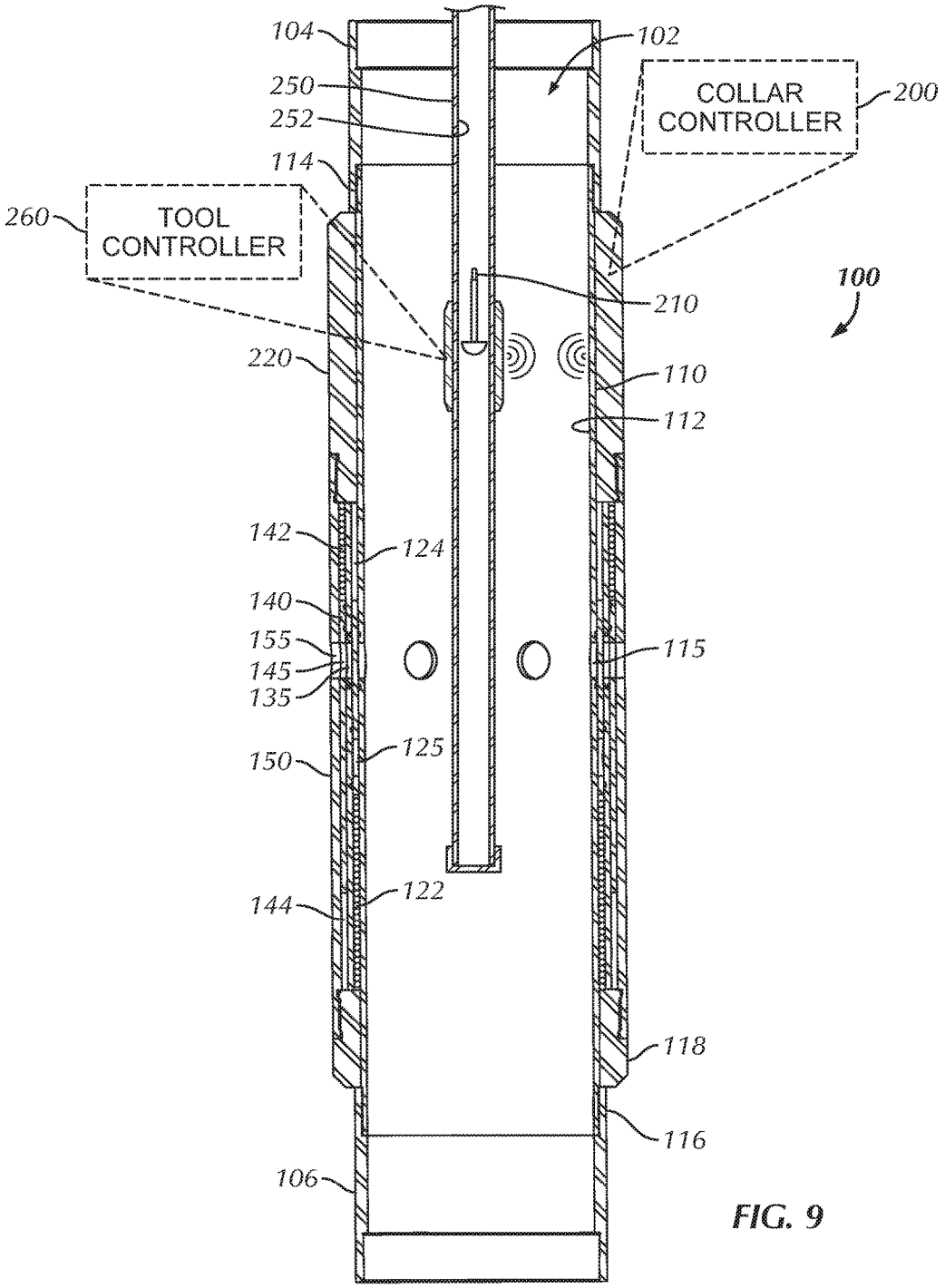
FIG. 9 diagrammatically illustrates another electronically-actuated port collar according to the present disclosure operated by an inner string.

FIG. 9 diagrammatically illustrates another electronically-actuated port collar 100 according to the present disclosure operated by a shifting tool 250. Components of this collar 100 are similar to those disclosed previously so that similar reference numbers are provided for like components. In contrast to previous embodiments, this collar 100 uses the shifting tool 250 deployed on coiled tubing, workstring, or the like to initiate actuation of the port collar 100 during cementing operations.

The shifting tool 250 can be independently deployed in the casing or may be part of an existing workstring deployed in the casing for the cementing operations. The shifting tool 250 includes a tool controller 260 that operates in conjunction with the collar controller 200 to operate the port collar 100 according to the purposes disclosed herein. The tool controller 260 can be operated using RFID tags 210, for example, deployed down the bore 252 of the tool 250, or the tool controller 260 can be operated using any of the other techniques known and disclosed herein. In fact, the tool controller 260 can be operated by any known form of telemetry—e.g., acoustic, electric, pressure, optical, etc.—via pulses, wires, cable, and the like conveyed by the tool 250 from the surface to the tool controller 260.

Either way, the tool controller 260 has transmission components, battery, and the like as disclosed herein so that instructions can be transmitted from the tool controller 260 to the collar controller 200 via radio frequency transmission. For example, the tool controller 260 can have RFID transmitter components to transmit a signal to the collar controller 200. For its part, the collar controller 200 can have many of the same components discussed previously, although the components may require less complexity because the tool controller 260 and its components act as an intermediary. Accordingly, details of the tool controller 260 and the collar controller 200 are not repeated here for brevity, as the particular details will be recognized based on the teachings of the present disclosure.

Operation of the port collar 100 can proceed as expected. The collar 100 can be deployed closed and can be set in position on the casing string in the wellbore. To commence cementing operations, operators open the port collar 100 using the shifting tool 100. In other words, the shifting tool 250 is used to initiate opening the port collar 100 according to the procedures outline herein. In one example, an RFID tag is deployed through the workstring to the shifting tool 250, and the tool controller 260 transmits RF instruction to the collar controller 200 to implement an appropriate action.

Depending on the implementation, the workstring having the shifting tool 250 may remain in the casing string or may be removed while cement slurry is communicated downhole. Eventually, once the staged cementation through the port collar 100 is complete, the shifting tool 250 is then used to initiate closing the port collar 100 according to the procedures outline herein. The shifting tool 250 can then be manipulated to another port collar or tool on the casing string for additional operations.

Figure 10A:
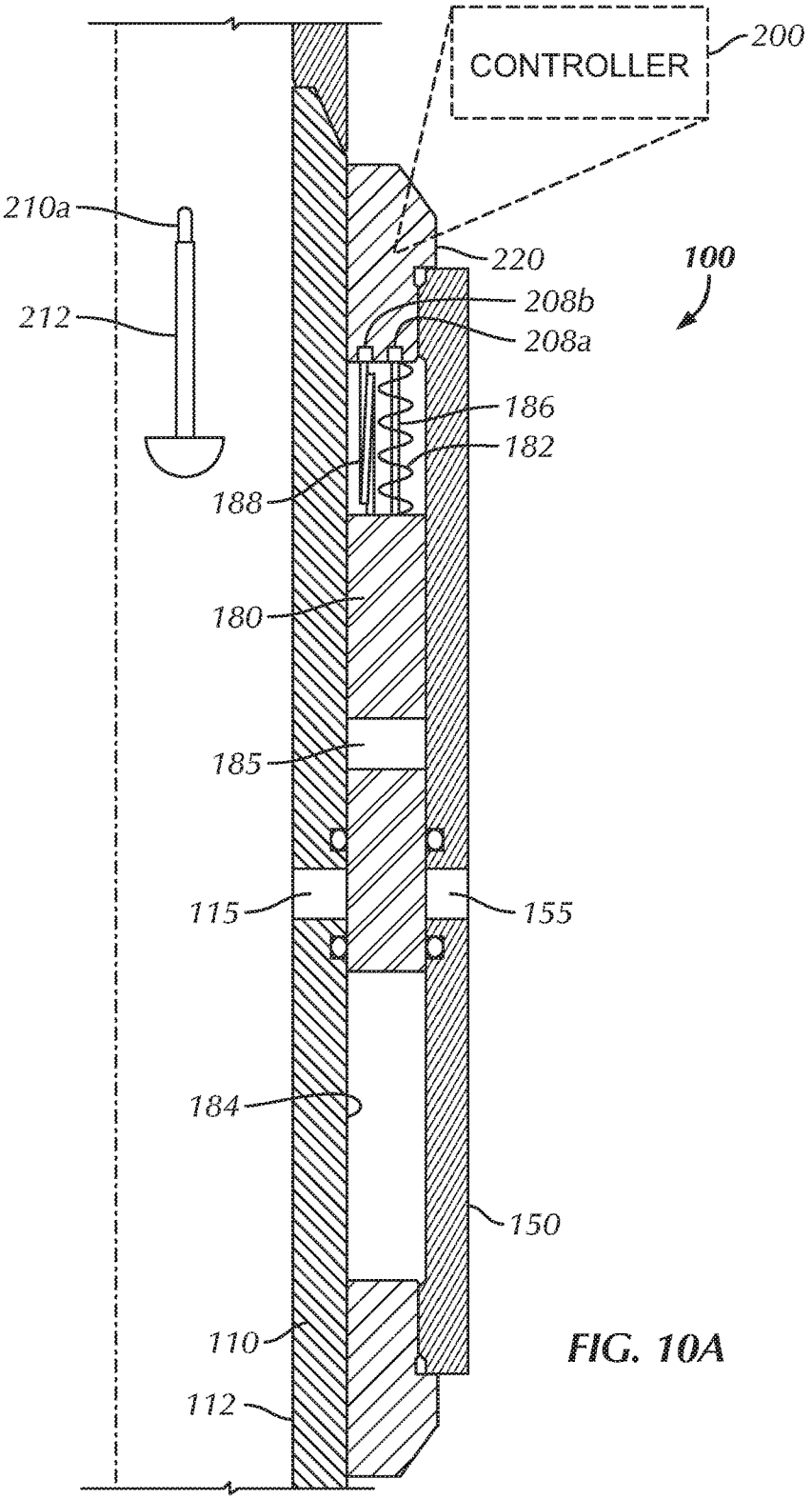
FIGS. 10A-10C diagrammatically illustrate operation of another electronically-actuated port collar according to the present disclosure.
Figure 10B:
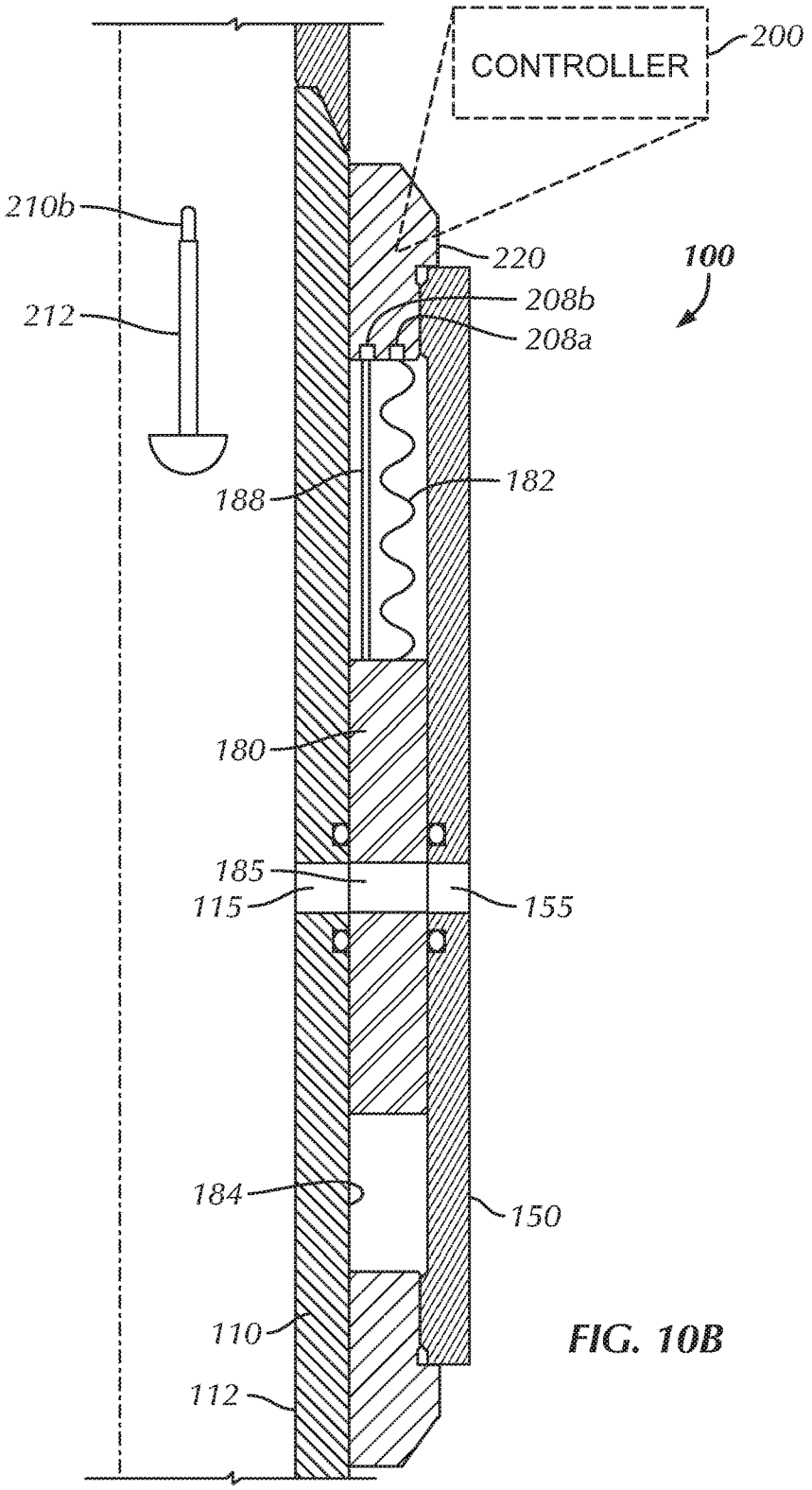
Figure 10C:
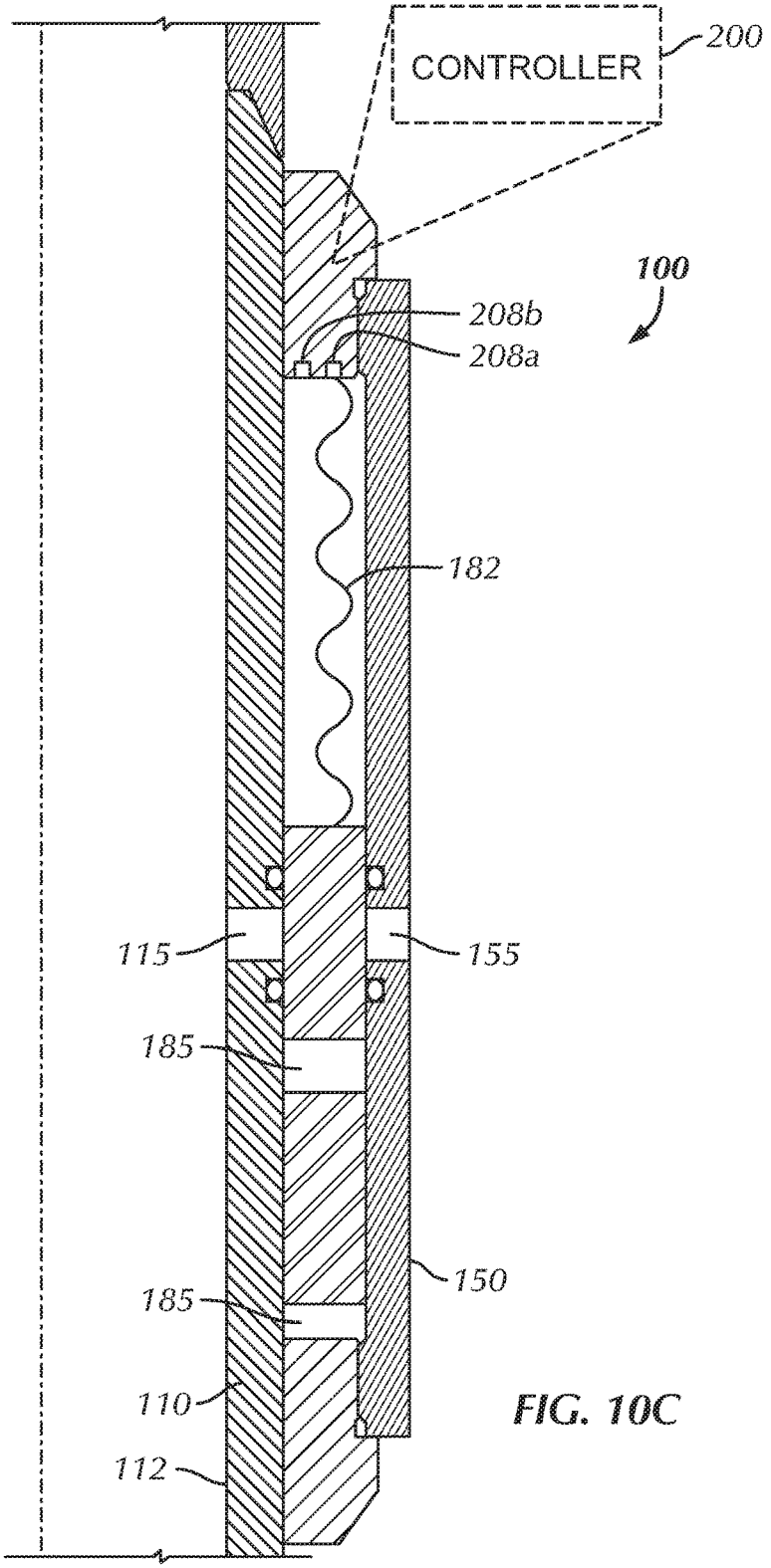

Previous embodiments as in FIGS. 7A-7B and 8A-8C used multiple sleeves and mandrels. As an alternative, FIGS. 10A-10C diagrammatically illustrate operation of another electronically-actuated port collar according to the present disclosure with a different configuration. Components of this port collar 100 have like reference numbers for similar components to previous embodiments. The port collar 100 defines a bore 102 therethrough that is roughly uniform and has an internal diameter roughly equal to the casing to which the collar 100 couples. An inner mandrel 110 of the port collar 100 has connector ends 104 and (not shown) for affixing the port collar 100 to the casing using conventional techniques. Disposed on the inner mandrel 110 are an end ring 118, a controller housing 220, a valve or sleeve 180, and an external mandrel 150—some of which move relative to the others.

To communicate cement slurry out of the collar's bore 102, the inner mandrel 110 includes one or more exit ports 115. The valve or sleeve 180 fits concentrically outside the inner mandrel 110. This sleeve 180 has its own ports 185 and can move relative to the exit ports 115 on the inner mandrel 110. In the closed position depicted in FIG. 10A, the sleeve 180 has a biasing member or spring 182 held in compression and has a space 184 for eventual travel of the sleeve 180. At least one of a pair of restraints 186 and 188 maintains the sleeve 180 closed.

Finally, the external mandrel 150 fits outside the sleeve 180 and has its own ports 155, which are aligned with the inner mandrel's exit ports 115. This external mandrel 150 does not move and is held between the end ring 118 and the controller's housing 220. It also includes various seals on the inside surrounding its ports 155 for sealing purposes.

When run-in on the casing string, the collar 100 has a closed condition as shown in FIG. 10A in which the sleeve 180 is held closed by at least a first restraint 186, such as a fiber band noted previously. Thus, full communication from the tool's bore 102 to the annulus is prevented by the opening sleeve 120.

Once the casing is positioned and cementing operations are to begin at the collar 100, operators then actuate the port collar 100 in an opening operation. For example, a first RFID tag 210*a* affixed to a directing dart 212 or the like is deployed down the casing in the fluid stream. The controller 200 detects passage of one of the RFID tag 210*a* and actuates a first fuse 208*a* to burn the first restraint 186 holding the opening sleeve 180 closed.

When the restraint 186 loses its tensile hold, the bias of the compressed spring 182 shifts the sleeve 180 to its opened position in the provided space 182, as shown in FIG. 10B. The sleeve's ports 185 are then aligned with all of the other ports 115 and 155. The spring 182 still remains compressed, but the second restraint 188 prevents further movement of the sleeve 180 in the space 182. Accordingly, in one arrangement, the second restraint 188 may comprise a longer length of fiber band than the first restraint 186.

With the port collar 100 open, cementing operations can be performed with the cement slurry able to pass out the aligned ports 115, 185, and 155 of the collar 100 and into the surrounding wellbore annulus. Eventually, operators will need to close the port collar 100 so the cement slurry can be closed off in the wellbore annulus and allowed to set. To do this, operators then actuate the port collar 100 in a closing operation. As shown in FIG. 10B, for example, a second RFID tag 210*b* affixed to a directing dart 212 or the like can be deployed down the casing in the fluid stream. Alternatively, the controller 200 may use timing logic to actuate after a defined period of time from the passage of the first tag 210*a*. In any event, the controller 200 actuates a second fuse 208*b* to burn the second restraint 188 holding the sleeve 180 opened.

When the second restraint 186 loses its tensile hold, the bias of the compressed spring 182 shifts the sleeve 180 to its next closed position in the provided space 182, as shown in FIG. 10C. In this condition, the sleeve's ports 185 no longer align with all of the other ports 115 and 155. Although not shown, lock rings, catches, and the like can be used to further hold the sleeve 180 open.

As can be seen in the port collar 100 of FIGS. 10A-10C, the sleeve 180, restraints 186 and 188, and any other related components operates as two valves—i.e. an opening valve and a closing valve—that can be operated sequentially during operations.

The foregoing description of preferred and other embodiments is not intended to limit or restrict the scope or applicability of the inventive concepts conceived of by the Applicants. For example, although the port collar 100 has been disclosed herein for use in cementing casing in a borehole, the port collar can be used for any other suitable purpose downhole in which a port needs to be opened and subsequently closed to first allow flow and then prevent flow through the port. Such a port collar could therefore be suited for sliding sleeves and another other downhole tool.

It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A port collar for use on casing in a borehole, the port collar comprising:

a housing disposed on the casing and having an internal bore, the housing having at least one exit port communicating the internal bore with the borehole;

an opening valve disposed on the housing and being movable from a closed position to an opened position relative to the at least one exit port;

a closing valve disposed on the housing and being movable from an opened position to a closed position relative to the at least one exit port;

at least one bias on the housing being independent of tubing pressure in the casing and of annulus pressure in the borehole and acting to move the opening and closing valves; and an electronic controller controlling the at least one bias, the electronic controller receiving at least one activation signal downhole at the port collar and at least activating in a first activation the opening valve to move via the at least one bias from the closed position to the opened position, wherein the closing valve is activated to move via the at least one bias from the opened position to the closed position at least after the first activation of the opening valve.

2. The port collar of claim 1, wherein the housing comprises an inner mandrel having the internal bore and having the at least one exit port.

3. The port collar of claim 2, wherein the opening valve comprises an opening sleeve disposed outside the inner mandrel and being movable relative thereto.

4. The port collar of claim 3, wherein the housing comprises an intermediate mandrel disposed outside the opening sleeve, the opening sleeve being movable in an annulus between the intermediate mandrel and the inner mandrel.

5. The port collar of claim 3, wherein the closing valve comprises a closing sleeve disposed outside the inner mandrel and being movable relative thereto.

6. The port collar of claim 5, wherein the housing comprises an external mandrel disposed outside the closing sleeve, the closing sleeve being movable in an annulus between the external mandrel and the inner mandrel.

7. The port collar of claim 1, wherein the electronic controller comprises a sensor responsive to the at least one activation signal.

8. The port collar of claim 7, wherein the sensor comprises a reader responsive to passage of at least one radio frequency identification tag.

9. The port collar of claim 1, further comprising a shifting tool deploying in the internal bore of the housing, the shifting tool providing the at least one activation signal.

10. The port collar of claim 1, wherein the opening valve is biased by the at least one bias from the closed position to the opened position; and wherein the electronic controller comprises a first restraint holding the opening valve biased in the closed position and releasing the opening valve biased to the opened position in response to the first activation from the electronic controller.

11. The port collar of claim 10, wherein the closing valve is biased by the at least one bias from the opened position to the closed position; and wherein the electronic controller comprises a second restraint holding the closing valve biased in the opened position and releasing the closing valve biased to the closed position in response to a second activation from the electronic controller.

12. The port collar of claim 10, wherein the first restraint comprises a member placed in tension and holding the biased opening valve closed.

13. The port collar of claim 12, wherein the member comprises a synthetic fiber.

14. The port collar of claim 10, wherein the first restraint comprises a fuse connected to the first restraint and breaking the first restraint in response to the first activation.

15. The port collar of claim 14, wherein the first restraint comprises a burnable member holding the biased closing valve opened, and wherein the fuse electrically burns the burnable member.

16. The port collar of claim 1, wherein the at least one bias acting to move the opening or closing valve comprises a biasing member biasing the opening or closing valve.

17. The port collar of claim 16, wherein the biasing member comprises a spring.

18. The port collar of claim 1, wherein the opening valve comprises an opening sleeve disposed on the housing and being movable relative to the at least one exit port; and wherein the closing valve comprises a closing sleeve disposed on the housing and being movable separately from the opening sleeve relative to the at least one exit port.

19. A port collar for use on casing in a borehole, the port collar comprising:

a housing disposed on the casing and having an internal bore, the housing having at least one exit port communicating the internal bore with the borehole;

an opening sleeve disposed on the housing and being movable from a closed position to an opened position relative to the at least one exit port, wherein the opening sleeve comprises at least one first port moving from a misaligned condition to an aligned condition with respect the at least one exit port with the movement of the opening sleeve from the closed position to the opened position; and a closing sleeve disposed on the housing and being movable from an opened position to a closed position relative to the at least one exit port, wherein the closing sleeve comprises at least one second port moving from an aligned condition to a misaligned condition with respect the at least one exit port with the movement of the closing sleeve from the opened position to the closed position; and an electronic controller receiving at least one activation signal downhole at the port collar and at least activating in a first activation the opening sleeve to move from the closed position to the opened position, wherein the closing sleeve is activated to move from the opened position to the closed position at least after the first activation of the opening sleeve.

20. A method of operating a port collar on casing in a borehole, the method comprising:

acting to move opening and closing valves on the port collar with at least one bias independent of tubing pressure in the casing and of annulus pressure in the borehole;

receiving at least one activation signal downhole with an electronic controller at the port collar;

activating, in a first activation of the electronic controller controlling the at least one bias in response to the at least one activation signal, the opening valve on the port collar to move via the at least one bias from a closed position to an opened position relative to at least one exit port on the port collar; and moving, at least after the first activation of the opening valve, the closing valve on the port collar via the at least one bias from an opened position to a closed position relative to the at least one exit port.

* * * * *